US007234701B2

(12) United States Patent
Hungerford

(10) Patent No.: US 7,234,701 B2
(45) Date of Patent: Jun. 26, 2007

(54) RIPOSTE SWORD-FIGHTING CARD GAME

(76) Inventor: Scott C. Hungerford, 9842 Vineyard Crest, Bellevue, WA (US) 98004

( * ) Notice: Subject to any disclaimer, the term of this patent is extended or adjusted under 35 U.S.C. 154(b) by 184 days.

(21) Appl. No.: 10/960,425

(22) Filed: Oct. 5, 2004

(65) Prior Publication Data

US 2006/0071428 A1 Apr. 6, 2006

(51) Int. Cl.
*A63F 1/00* (2006.01)

(52) U.S. Cl. ..... 273/292

(58) Field of Classification Search ..... 273/292
See application file for complete search history.

(56) References Cited

U.S. PATENT DOCUMENTS

| | | | | | |
|---|---|---|---|---|---|
| 739,678 | A * | 9/1903 | Ives | 273/292 |
| 1,117,316 | A * | 11/1914 | Booton | 273/306 |
| 1,146,798 | A * | 7/1915 | Jamer | 273/297 |
| 1,287,317 | A * | 12/1918 | Hopkins | 273/306 |
| 1,322,954 | A * | 11/1919 | Rosenfeld | 273/298 |
| 1,355,782 | A * | 10/1920 | Roy | 273/306 |
| 1,404,599 | A * | 1/1922 | Glenny | 273/244 |
| 1,631,009 | A * | 5/1927 | Clark | 273/306 |
| 3,756,604 | A * | 9/1973 | Laszlo | 273/255 |
| 4,346,897 | A * | 8/1982 | Sisak | 273/271 |
| 4,415,160 | A * | 11/1983 | Lamb | 273/243 |
| 4,635,939 | A * | 1/1987 | Makow | 273/296 |
| 4,861,031 | A * | 8/1989 | Simms | 273/295 |
| 5,040,796 | A * | 8/1991 | Schall | 463/22 |
| 5,090,707 | A * | 2/1992 | Patz | 273/298 |
| 5,106,100 | A * | 4/1992 | Yih | 273/306 |
| 5,435,568 | A * | 7/1995 | Black | 273/303 |
| 6,254,099 | B1 | 7/2001 | Pederson | 273/292 |
| 6,328,308 | B1 * | 12/2001 | Kirby | 273/299 |
| 6,450,498 | B1 * | 9/2002 | Rombone | 273/255 |
| 6,554,702 | B2 * | 4/2003 | Mahar et al. | 463/11 |
| 6,702,290 | B2 * | 3/2004 | Buono-Correa et al. | 273/292 |
| 2003/0020239 | A1 * | 1/2003 | Hagen et al. | 273/296 |
| 2003/0137107 | A1 * | 7/2003 | Rubin | 273/292 |
| 2004/0046319 | A1 * | 3/2004 | Merritt, III | 273/236 |
| 2005/0077680 | A1 * | 4/2005 | Chen | 273/292 |
| 2006/0038349 | A1 * | 2/2006 | Meeks | 273/308 |

* cited by examiner

*Primary Examiner*—Eugene Kim
*Assistant Examiner*—Dolores R. Collins
(74) *Attorney, Agent, or Firm*—Dean A. Craine

(57) ABSTRACT

A card game designed to simulate movements and activities between two combatants. The object of the game is to force all the other players to lose their game points before the winner does. The game uses a unique set of playing cards each containing one of three possible main color codes, and up to three out of four possible activity symbols. Each activity symbol is associated or linked to a second color code that matches one of the three main color codes. The game is presented herein as a sword fighting game between combatants. The activity symbols represent various offensive and defensive activities performed by opposing players during a sword fight. During the game, an offensive player selects an opposing player to attack after reviewing his or her holding cards and the top card in the discard pile of the other player. The defender must either dodge, parry or riposte the attack. If the defender cannot defend the attack, then he or she loses a game point(s) equal to the value of the number of game point(s) on the card played by the offensive player. The last player to possess game points wins the game.

7 Claims, 4 Drawing Sheets

RIPOSTE SWORD-FIGHTING CARD GAME

BACKGROUND OF THE INVENTION

1. Field of the Invention

The present invention relates to games, and more particular to card games that simulate sporting or fighting activities between combatants.

2. Description of the Related Art

Sword-fighting is an ancient fighting activity between two or more combatants attempting to kill or seriously injure each other with a sword. To be successful swordfighters, the individuals must not only learn how a series of offensive moves (called attacks) used to kill or injure his or her opponent with a sword but also a series of defensive moves to avoid (called a dodge) or deflect (called a parry) the opponent's sword. When attacking, the offensive opponent may be temporarily unbalanced and vulnerable to a counter move by the defending opponent, known as a riposte. In many instances, defenders will intentionally present or display a weakness, only to respond by a deadly riposte. These activities of attacking, dodging, deflecting and riposting and the display of weakness to entice a desired response, makes sword-fighting an exciting sport to watch and to play.

SUMMARY OF THE INVENTION

It is an object of the present invention to provide a card game that simulates the activities and strategies used between two combatants.

It is another object of the present invention to provide such a game that is easy to learn and can be played with two or more players.

These and other objects of the present invention are met by a card game disclosed herein designed to simulate the physical activities and strategies used between two combatants. The ultimate object of the game is for one player to accumulate game points or take away or eliminate the game points from all the other opponents. The game points are accumulated or lost by players individually challenging other players to individual physical challenges. During a challenge, two players square off and exchange playing cards having different values. When the challenge is completed, one player is given game points or retains his game points while the other player loses his game points depending on the game theme. In some instances, the challenge results in the players playing to a draw in which neither player gains or loses a game point. If a player accumulates a specific number of game points or if all but one of the players loses their game points, that player becomes the overall winner of the game. If the object of the game is to take away game points from other players, then the players may be individually disqualified or eliminated from the game when all of their game points are lost.

To illustrate the object and flow of the game, a game is described as a sword-fighting game where individual players are assigned a specific number of game points, also called life points. During the course of the game, the individual players enter into sword-fighting matches or duels with another player which results in a draw where the players retain their life points or one player losing his or her life points.

The game uses a unique set of playing cards each containing one of three possible main color codes, and up to three out of four possible activity symbols. Each action symbol is associated or linked to a second color code that matches one of the three main color codes. In the preferred embodiment, one main color code is clearly printed in a vertical column printed on the front surface and adjacent to a vertical edge.

The action symbols represent activities performed by the players during a combat. In the sword-fighting game, the four possible action symbols are attack, dodge, parry and riposte. In the preferred embodiment, three action symbols printed in vertical row on the front surface on each card parallel to the main color code. Each action symbol is printed over one of three secondary color codes. The three secondary color codes may be the same or any combination thereof. During play, the defenders action is determined by the action symbol on a second color code that matches the main color code on the offensive player's top card on the discard pile. The defender plays his or her card by placing it face down on his or her discard pile. The main color code, the three action symbols and the secondary color code are sufficiently large so that they may be easily identified by all of the players when the card is placed face down on the discard pile.

During the course of play, a dealer is selected who shuffles the cards and deals five cards 'face-down' and one card 'face-up' in front of each player. The 'face-up' card starts the player's discard pile. The player with the discard card having the highest value may be designated to go first. When a player has a turn to play, he or she may attack, pass or lose a life point, called 'bleeding'. Which particular action the player chooses depends on several factors, such as the main color codes on the top cards of the other players' discard piles, the quality of the attack symbols on the matching secondary color codes on the cards held in the player's hand, the number of life points assigned to the action symbols, and the total number of life points possessed by the other players. When a player elects to attack another player, he or she announces the opposing player's name and the life point value of the attack. The defender must either dodge, parry or riposte the attack. If the defender cannot defend the attack, then he or she loses a life point(s) equal to the value of the number of life point(s) played by the attacker.

When the offensive player begins play he or she must select a card with the desired attack symbol associated with a second color code that matches the main color code on the opposing player's card. When the card is played, it is played 'face-up' on the player's discard pile. The defender then reviews the main color code on the offensive player's top card in the discard pile and chooses one of three possible defensive moves—a dodge, a parry or a riposte. Like the offensive player, the specific possible action symbol used by the defender is controlled by the second color associated with the action symbol that matches the main color code on the offensive player's top card. If the offensive player cannot play a card, then he must either pass or 'bleed'.

As stated above, the defender loses life points if he or she does not defend against the attack. The defender also loses life points if he or she elects to parry with a card that has less life point(s) value than the offensive player's card. If the defender responds with a dodge, the defender negates the attack entirely, but the attacker keeps control and may attack the same player again or attack another player with another card. If the defender elects to parry and the numeric value of his parry is equal or greater than the attack value of the offensive player's attack, then neither player loses life point, and the defender gets to have the next turn. If the defender ripostes, he or she blocks an attack of any strength, and the defender automatically gains control and gets to have the next turn.

During the course of the game, action between the players is fast, random and constantly changing. Theatrical challenges may be issued between the players making the game humorous and yet challenging.

DESCRIPTION OF THE PREFERRED EMBODIMENT(S)

Figure 1:
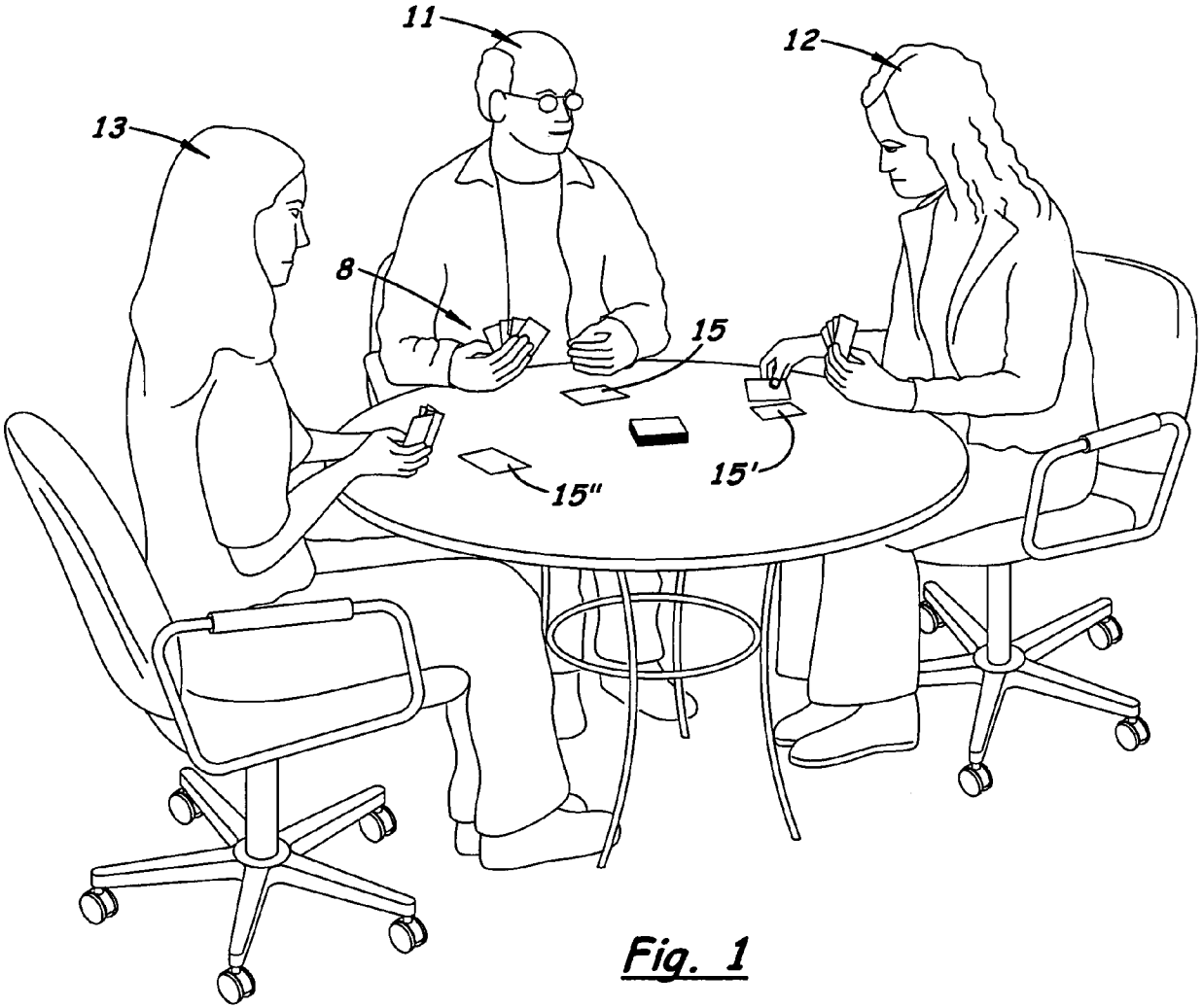
FIG. 1 is a perspective view of three players sitting around a table playing the card game disclosed herein.

Referring to the Figs., there is shown a game 8 that uses a novel set of cards generally designated as 10, designed to simulate the physical activities and strategies used between two combatants. The ultimate object of the game 8 is for one player to accumulate game points or take away or eliminate game points from all other players. The game points are accumulated or lost by players who individually challenge other players to physical challenges that simulate a normal physical combative or competitive activity, such as sword-fighting, baseball, soccer, or basketball, etc.

During the game 8, challenges are made between players by exchanging playing cards having different values. Which card is played by a player is partially controlled by the main and secondary color codes on the cards held by the player and on the most recent discard card played by the opposing player, the offensive and defensive nature of the activity symbols printed on the cards and the secondary color codes associated with the symbols, and the game point values associated with the activity symbols. When a challenge between players is completed, one player is given game points or retains his game points while the other player loses game points or retains game points depending on the game objective. In some instances, the challenge results in a draw in which neither player gains or loses a game point. If a player accumulates a specific number of game points or if all but one player loses their game points, the player becomes the overall winner. Alternatively, the winner may be determined by the player with the greatest number of game points after a selected time period or when all of the cards in the deck of cards have been drawn or played.

By way of example, the game disclosed herein is described as a card game 8 designed to simulate movements and activities between two sword-fighting combatants. It should be understood that the game is not limited to a physical card game but could be incorporated into a software program that presents a virtual card game. It should also be understood that the nature of the game is also not limited to sword-fighting combatants and could be between combatants in other activities.

The object of the game 8 when used to simulate a sword fight is to force all the other players to lose their game points, also called life points, before the winner does. The game uses a set of unique playing cards 10 with each card 30–132 containing four key elements—a main color code 140, three secondary color codes 142, 144, 146, an activity symbol 150, and a life point value 160, 162, 164. The main color code 140, 140', 140" and second color codes 142, 144, 146 are taken from a set of three unique colors, i.e. red, green and blue. The activity symbol 150 is taken from a set of four activity symbols 152, 154, 156, 158 shown in FIG. 6. The activity symbols 152, 154, and 156, 158 are divided into two groups—an offensive group designated 151 and a defensive group designated 155, respectively. Offensive activity symbol 152 is assigned a game point 160 having a value between 2 and 5.

Figure 2:
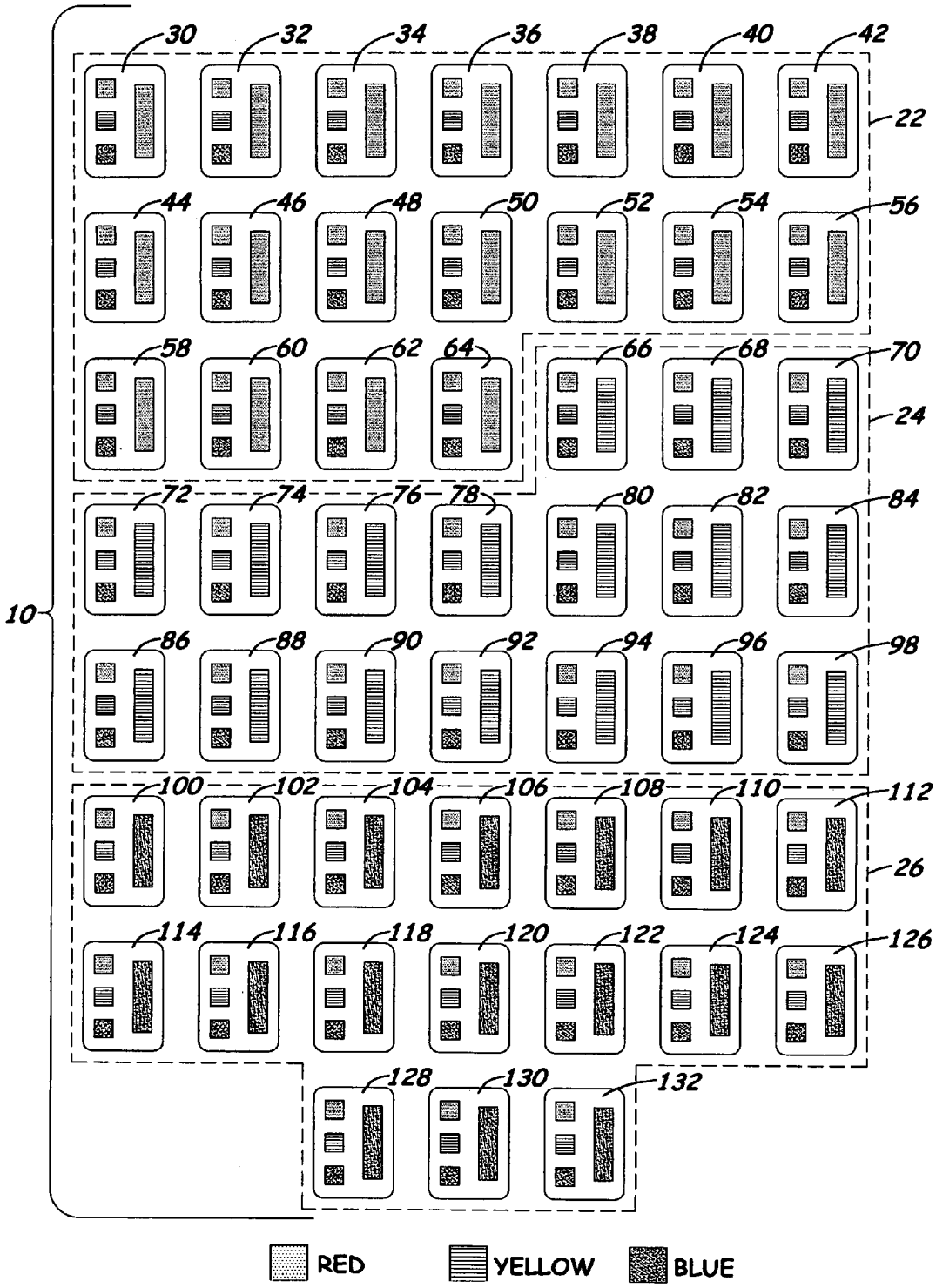
FIG. 2 is a top plan view of the deck of cards used in the card game.
Figure 3:
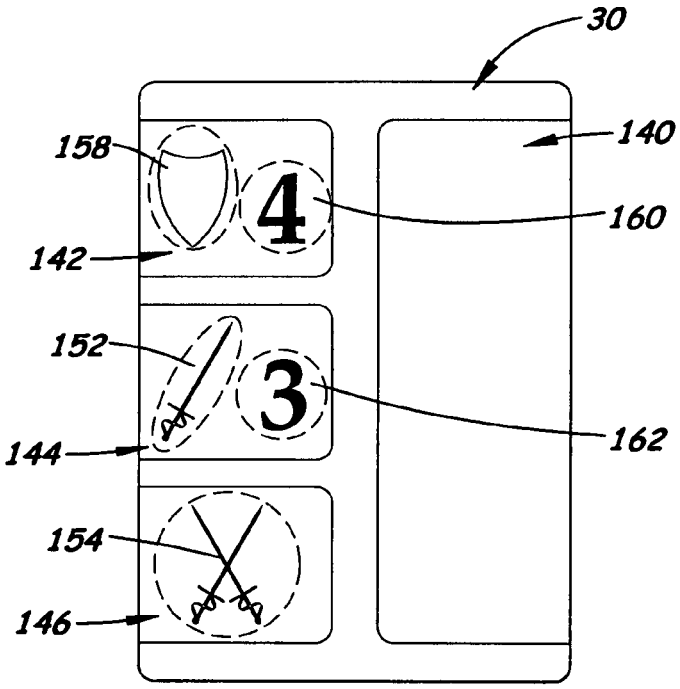
FIG. 3 is a top plan view of a card from the first set of cards used in the card game.
Figure 4:
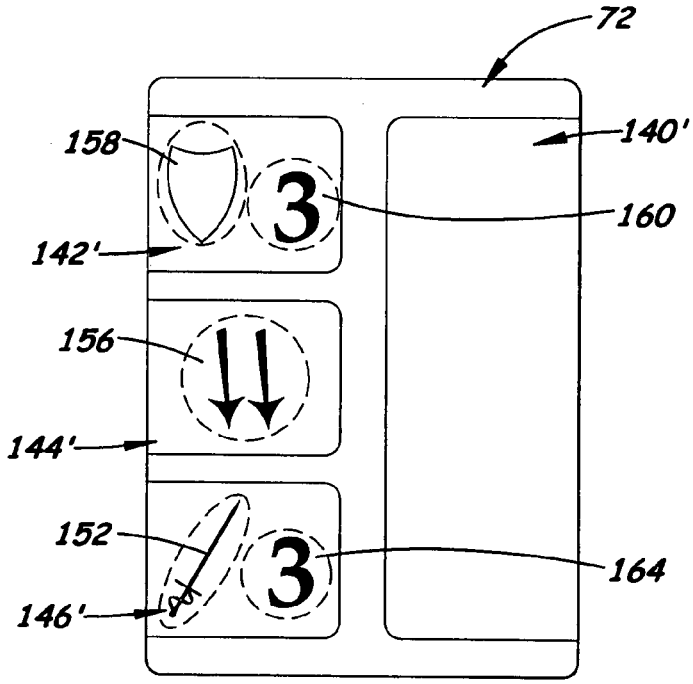
FIG. 4 is a top plan view of a card from the second set of cards used in the card game.
Figure 5:
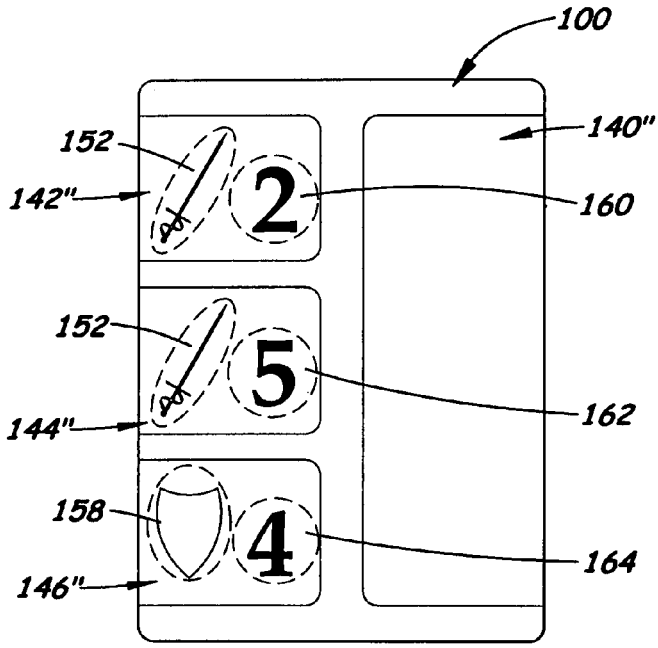
FIG. 5 is a top plan view of a card from the third set of cards used in the card game.

As shown in FIG. 2, the set of cards 10 includes fifty-two unique cards 30–132. FIGS. 3, 4, and 5 show three representative cards 30, 72 and 100, respectively, each including a vertical main color code 140, 140', 140" printed along one edge. As stated above, the main color codes 140, 140', 140" is one color taken from a set containing red, green, and blue. The first group of eighteen cards (30–64), denoted 22, have one main color 140, the second group of seventeen cards (66–96), denoted 24, have a second main color code 140', and the third group of seventeen cards (100–132), denoted 26, have a third main color code 140". In the preferred embodiment, the main color code, 140, 140', 140" is shown by a colored vertical stripe printed along one edge of the card. It should be understood that the color codes 140, 140'and 140" could be shown in another manner on the card, such as a dot, a circle, a box, etc.

Located on the edge of each card 30–132 opposite the main color code 140, 140', 140"is a vertical row of three color boxes 142, 144, 146; 142', 144', 146'; and 142", 144", 146", respectively. Printed in each color box is one activity symbol 152, 154, 156, or 158. Activity symbols 152, 154 are regarded as 'offensive' activity symbol 152 is assigned a life point value between 2 and 5. No life point value is assigned to the riposte activity symbol 154. Activity symbol 156 is regarded as 'defensive' and assigned a life point value between 1 and 4. Activity symbol 158 is also regarded as 'defensive' and has no life point value assigned thereto.

FIG. 1 shows three players 11, 12, 13 sitting around a table and playing the game 8 using the set of cards 10 disclosed herein. At the start of the game 8, one player, (player 11) is designated as the dealer who shuffles the set of cards 10 and deals five cards 'face-down' and one card 'face-up' to himself 11 and all of the other players 12, 13. The 'face-up' card 15 starts the player's discard pile. The remaining cards in the deck are placed 'face-down' at the center of the table. Normally, the player with the discard card having the highest speed value goes first. After the first player 12 to the left of the dealer 11 has completed her turn, generally the player sitting to her left (player 13) plays next. It should be understood that it is possible through the course of play that another player may play next. The players play in a clockwise rotation around the table until a winner is declared. It should be understood that other methods to determining the first player in the game may be used.

At the beginning of the game, each player is given seven game or life points. Optional chips may be given to each player and stacked in front of each player that visually represent the number of life points the player has remaining in the game. When a player loses a life point, he or she places one chip into a pile located at the center of the table. At the end of the game, the player with the most chips is declared the winner.

If the player elects to attack, he or she picks an opposing player and announces the player's name and the number of life points he is playing. The opposing player, now called a defender, must fight off the attack with a card with a suitable defensive activity symbol. Alternatively, the defender may successively fight off the attack and take control away from the player. Such action is referred to as a riposte and is included as an activity symbol.

During play, the offensive player plays the card 'face-up' on his discard pile. Which specific card is selected and played is initially determined by the main color code on the top card on the defender's discard pile. When responding to the offensive player, the defender must select a card with a defensive or riposte activity symbol assigned to a secondary color code that matches the main color code on the offensive player's card.

During play, the defenders action is determined by the action symbol on a second color code that matches the main color code on the offensive player's top card on the discard pile. The defender plays his or her card by placing it face up on his or her discard pile. The main color code, the three action symbols and the secondary color code are sufficiently large so that they may be easily identified by all of the players when the card is placed face up on the discard pile.

In a sword-fighting game, the defender's choice of activity includes dodge, parry, or riposte when attacked as shown in FIG. 3. If the defender elects to dodge, he or she negates the attack, but the offensive player keeps control and gets to make the next attack. When playing a dodge activity card, the life points are not allocated between players. If the defender elects to parry, the life points on the card and the comparative values of the life points on the two cards are used to determine the winner. For example, if the amount of the parry is equal or greater than the life points on the attack number, then the attack is considered blocked and the defender now becomes the offensive player and plays the next card. For example, a 4 point attack matched against a 2 point parry, results in the defender losing two life points and the attacker gets to play the next card. A 3 point attack matched against a 3 parry means that the defender loses no life points, and the defender gets to play the next card. A 2 point attack matched against a 4 point parry, means the defender loses no life points and the defender gets to play the next card. If the defender has no defensive actions, such as parry, dodge, or riposte, they take full damage from the attack and it is still the offensive player's turn. When the defender ripostes, he or she blocks the attack and the defender becomes the offensive player and gets to play the next card.

The following text describes the order of play. The first player 11 has the card 72 shown in FIG. 4 in his hand. The second player 12 has the card 30 shown in FIG. 3 in his hand. The second player 12 also has the card 100 shown in FIG. 5 face-up on the top of his discard pile 15'. The first player 11 notes that the top card 100 has a main color code 140". The first player 11 then reviews his own card 72 to determine whether he has an 'attack' activity symbol in a second color code box that is the same color as the main color code 140". Because the card 72 does have an 'attack' activity symbol in a secondary color code 146 that matches the main color code 140" on the top card of his opponent's discard pile, he now declares that he is making an attack against the second player worth 3 life points. The first player 11 then places the card 72 face-up on his own discard pile 15.

Figure 6:
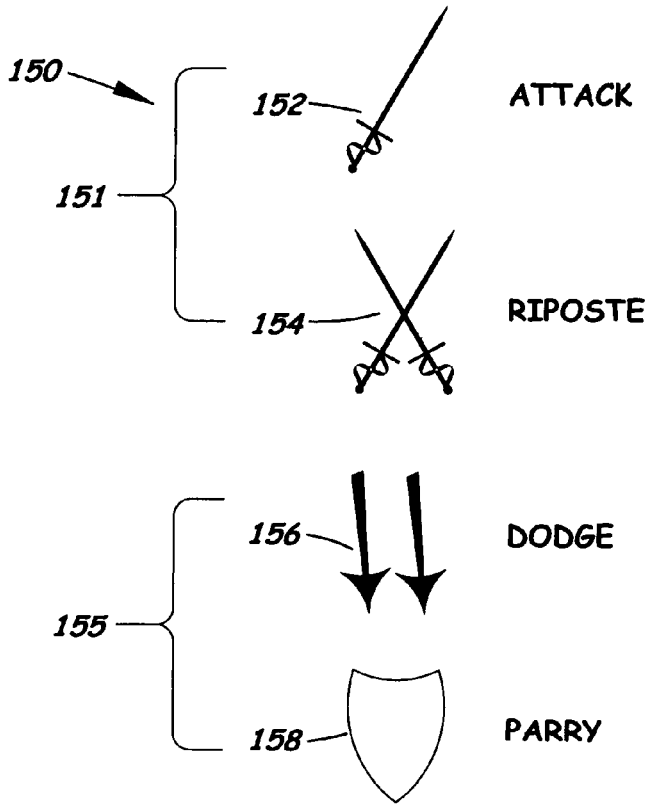
FIG. 6 is an illustration of the four types of activity symbols used on the cards shown in FIGS. 2–5.

The second player 12, checking the top card 72 on the first player's discard pile (FIG. 4), specifically notes card's main color code 140'. The second player 12 then consults his own card 30 held in her hand to determine whether she has a defensive action to play—either a parry, dodge or riposte (FIG. 6). As the second player's card has a 'riposte' activity symbol 154 in the secondary color code 146 that matches the main color code 140' on the top card 72 of the first player's discard pile 15, she would declare that he is making a "riposte" action, announces that he loses no life points, and places her card 30 face-up on top of her own discard pile. The first player's attack is completely negated, the second player 12 loses no life points, and it becomes the second player's turn.

Instead of playing an offensive card, the first player 11, may choose to pass instead of attack. When this occurs, the offensive player and all the other players are dealt one card from the deck by the dealer. The player to the left of the player who passes now becomes new offensive player who takes control of the game and can play the next card. Alternatively, the first player 11 may choose to 'bleed' instead of attack or pass. When a player chooses to 'bleed', he or she loses one life point, is dealt two cards, and the player to the left of the "bleeding" player now becomes the offensive player who takes control of the game and can play the next card.

The set of cards 10 may be modified to simulate competition between opponents in a field-related game sport, such as football, soccer, hockey, lacrosse, basketball, and rugby or a net related game such as tennis, badminton, table tennis, etc, or simulate competition between combatants in combative games or simulations such as paintball, boxing, wrestling, martial combat, vehicle combat, magical combat or other kinds of duels. For each type of combative game, the basic components, such as three sets cards, each having one of three possible main color codes, matching secondary color codes, and activity symbols are identical. The nature of the activity symbols are changed to match one offensive and three defensive activities used by players in the field sport. The point values of the cards should be considered optional components and may be adjusted to match the points scored during the simulated game. For example, in football, a team awarded a touchdown is given six points. In basketball, a team awarded a field goal is given 2 or 3 pts. In soccer, a field goal is worth 1 point. In these types of games the objective of the game is modified so that the player earning the most points during play, wins the game.

In summary, the game is elegant, swift, easy to learn and very fun to play. The game may be printed on standard sheet of playing card stock and distributed with existing playing cards or reproduced on an electronic medium. Riposte is the strongest play and dodge is the second strongest play. Both plays have no life points value assigned to them yet both defeat attacks of any life point value. Turn passes when a player successfully riposte after an attack; he or she becomes the offensive player.

When a player successfully parries (4 is matched with 4) then he becomes the offensive player. When a player passes or bleeds, the player to the left becomes the offensive player.

In compliance with the statute, the invention described herein has been described in language more or less specific as to structural features. It should be understood, however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A method for playing a card game that simulates the physical activities between two players, comprising the following steps;

a. selecting a card game set that includes three sets of cards, each set of card including one of three possible main color codes, at least three activity symbols printed on each said card, each said activity symbol used to depict at a least one offensive and at least one defensive activity performed by a player during the combative activity and a second color code assigned to each said activity symbol, said second color code being one of the possible main color codes;

b. designating a dealer, said dealer shuffles said cards and deals an equal number of cards to each player, one card being dealt facing upward and the other said cards being dealt facing downward;

c. designating a first offensive player;

d said first offensive player determines the main color code, the secondary color codes, the activity symbol and the game point value of said activity symbol if any for each said card held by said player;

e. said first offensive player reviews the top upward facing card given to all other players and determines the main color code, the secondary color codes, the activity symbols on each said secondary color codes printed thereon, and the game point value displayed thereon;

f. said first offensive player choosing a card and an opposing player to attack based on the comparative values of each card held by said first player and the values of each said top upward facing card for each opposing player, said comparative values being determined by considering the main color code, secondary color codes, the activity symbols and any game point associated with said cards held by said first player and said top upward facing cards for each opposing player;

g. playing said chosen card against said chosen opposing player;

h. determining the winning player between the first offensive player and said opposing player, said winning player now repeating steps (e–g.) to determine a next offensive player; and, i. repeating step (h) until a final player is declared the winner.

2. The method as recited in claim 1, wherein said activity symbols are classified as offensive activities and defensive activities.

3. The method as recited in claim 2, wherein said offensive activity symbols include attack and riposte and said defensive activities include parry and dodge.

4. The method as recited in claim 3, wherein said attack symbol is assigned a game value between 1 and 5.

5. The method as recited in claim 3, wherein said riposte symbol is assigned a game point value between 1 and 5.

6. The method as recited in claim 4, wherein said riposte symbol is assigned a game point value between 1 and 5.

7. A method of playing a sword fighting game, comprising the following steps:

a. selecting a deck of cards designed to simulate a plurality of sword fights between combatants, said deck of cards consisting of fifty-two cards, each said card having a unique combination of the following: one of three main color codes, one of three possible secondary color codes, and three of four possible activity codes, each said activity code being associated with a secondary color code;

b designating a dealer of a set of cards;

c dealing a equal number of cards to each player, one said card being dealt facing upward and the other cards being dealt facing downward;

d. designating a first offensive player;

e said first offensive player determines the main color code, the secondary color codes, the activity symbol and the life point value of said activity symbol for each said card;

f. said first offensive player reviews the top upward facing upward card given to all other players and determines the main color code, the secondary color codes, the activity symbols on each secondary color codes, and the life point value displayed thereon;

g. said first offensive player choosing an opposing player to attack based on the comparative values of each card held by said first player and the values of each said top upward facing card for each opposing player, said comparative values being determined by considering the main color code, secondary color codes, the activity symbols and any life point associated with said cards held by said first player and said top upward facing cards for each opposing player;

h. determining the winning player between the first offensive player and said opposing player, said winning player now repeating step (g.) to determine a next offensive player; and, i. repeating step (g.) until a final player is declared the winner.

* * * * *